US005458301A

United States Patent [19]

Cournoyer

[11] Patent Number: 5,458,301

[45] Date of Patent: Oct. 17, 1995

[54] OPEN HANDBAG/GROCERY BAG HOLDER

[76] Inventor: Roger J. A. Cournoyer, 4299 NW. 16th St., #203, Lauderhill, Fla. 33313

[21] Appl. No.: 224,715

[22] Filed: Apr. 8, 1994

[51] Int. Cl.[6] ..... B65B 67/04

[52] U.S. Cl. ..... 248/95; 248/99; 248/100

[58] Field of Search ..... 248/95, 99, 100, 248/303, 305, 316.7, 864, 293; 211/12, 113, 119, 116, 170, 199; 24/546, 556, 555

[56] References Cited

U.S. PATENT DOCUMENTS

| | | | |
|---|---|---|---|
| 461,291 | 10/1891 | Timmerman | 248/100 |
| 3,220,434 | 11/1965 | Garth | 248/100 |
| 4,118,001 | 10/1978 | Serkez | 248/308 |
| 4,538,783 | 9/1985 | Stobbe | 248/100 |
| 4,579,307 | 4/1986 | Malik | 248/99 |
| 4,946,065 | 8/1990 | Goulter | 248/95 |
| 4,978,093 | 12/1990 | Kennedy | 248/205.1 |
| 4,997,149 | 5/1991 | Koch | 248/100 |
| 4,998,694 | 3/1991 | Barteaux | 248/100 |
| 5,094,417 | 3/1992 | Creed | 248/215 |

*Primary Examiner*—Leslie A. Braun
*Assistant Examiner*—Gwendolyn Wrenn
*Attorney, Agent, or Firm*—Alvin S. Blum

[57] ABSTRACT

A purse or handbag holder has a rigid body with a flat bottom for resting upon the edge of a horizontal support surface. The body has two opposed long sides. A pair of hook members are pivotally attached to, and extend horizontally from, one long side, one at each end of the long side so that they are spaced apart. In operating mode each hook member extends downward to provide a pair of strap hooks beneath the body. When a purse is hung from the holder with one strap in each hook, the purse is held open beneath the table for easy one hand access. The body may be cushioned for carrying plastic grocery bags. In storage mode the hook members pivot to parallel the body and springably engage each other. An alternative embodiment has springably closed strap engaging hooks which may grip a purse strap at any point along its length to adjust purse elevation below the support.

10 Claims, 1 Drawing Sheet

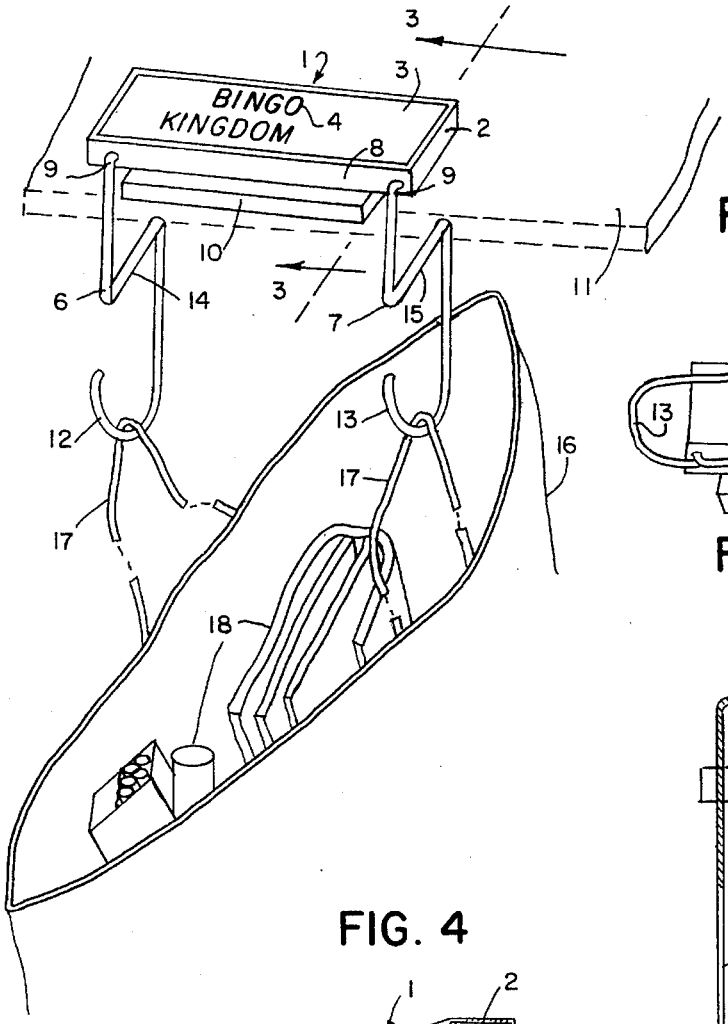
FIG. 1
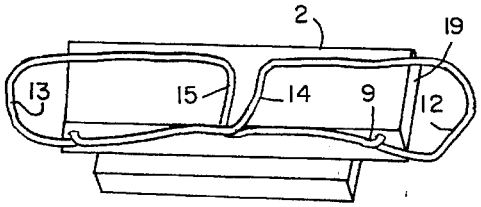
FIG. 2
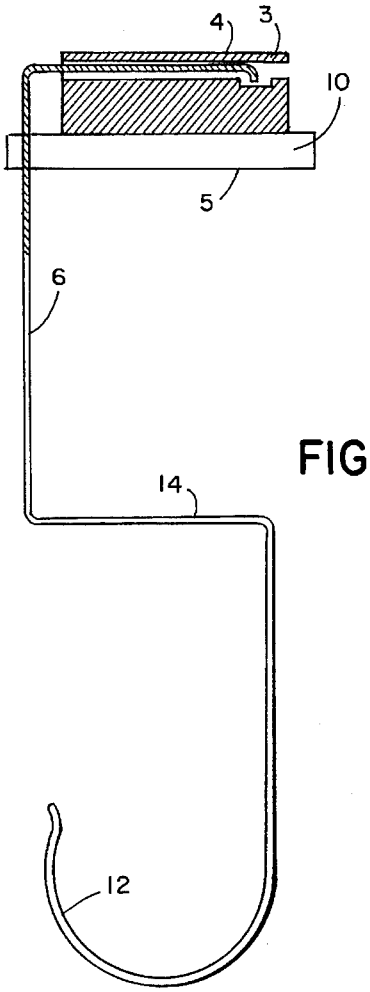
FIG. 3
FIG. 4
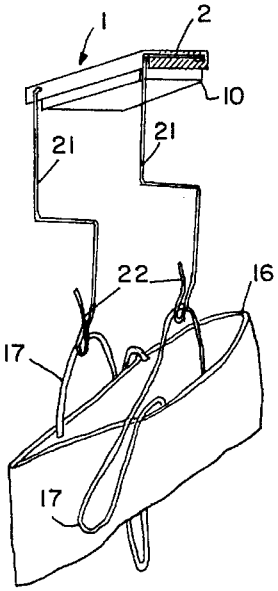

OPEN HANDBAG/GROCERY BAG HOLDER

BACKGROUND OF THE INVENTION

This invention relates to devices that may be placed at an edge of a table to support a handbag below the table surface and more particularly to such a device to provide two spaced apart hooks for holding a purse open by two straps with a resilient grip for hand carrying a plastic grocery bag.

It is well known to provide a handbag or purse holder for use when seated at a table or desk, such as when playing games of chance. These devices have a flat body to rest upon a horizontal surface at the edge of the table. A hook extends from the body over the edge of the table and then downward, and often under the body so that the center of gravity of the hook where the purse strap is held is below the table top for enhanced stability. The hook may pivot or swivel into the body for storage convenience.

When seated for prolonged periods, the user may on occassion require access to the purse. With holders of the prior art, the user will generally require two hands to open the purse and insert or remove an item. Since many bags and purses have two straps or handles, it would be useful to provide a purse holder which would not only hold the purse in place below the table top, but also allow it to be held open so that the user could freely access the contents with one hand. It would also be useful if the holder could be folded into a compact form with the parts protected for carrying in the purse. It would also be useful if the device could also serve as a handle for carrying plastic grocery bags.

SUMMARY OF THE INVENTION

It is accordingly an object of the invention to provide a purse or handbag holder that will hold the two straps of a bag spaced apart and below a horizontal surface with a pair of hooks that pivot to a closed position with the hooks protected from catching items when stored in the bag. The holder is provided with a flat body portion to which a pair of hooks are pivotally attached. The hooks may be of the open type or they may alternatively be provided with a springy closure for gripping extra long straps at selected positions. The body may be provided with a resilient cushioned surface to form a comfortable handle for carrying about a loaded plastic grocery bag. A flat surface for bearing advertising may be provided atop the body.

These and other objects, advantages and features will become apparent when the detailed description is considered in conjunction with the drawings.

BRIEF DESCRIPTION OF THE DRAWINGS

FIG. 1 is a perspective view of the holder in operation.

FIG. 2 is a perspective view of the holder in storage mode.

FIG. 3 is a sectional view taken through line 3—3 of FIG. 1.

FIG. 4 is a sectional view of another embodiment of the invention.

DETAILED DESCRIPTION OF PREFERRED EMBODIMENTS

Referring now first to FIGS. 1–3, the purse holder 1 of the invention comprises a flat rigid plastic body 2 having broad upper face 3 which may support advertising indicia 4 such as by an adhesively applied label. The body has a lower face 5 which may be provided with a high friction, resilient cushioning material 10 such as an elastomeric foam. A pair of hook members 6 and 7 are pivotally attached at a proximal end 9 to the body 2 and both extend out laterally from a long side 8 of the body. Each hook member is bent into a shape having a substantially planar configuration with a strap hook 12, 13 at its distal end. In the operational mode shown in FIG. 1, the body 2 rests upon the top edge of a horizontal support surface 11 such as a gaming table. Each hook member 6, 7 is pivoted so that its plane is perpendicular to the table top with the hook member extending downward past the edge of the table. A horizontal leg 14, 15 extends under the table so that the purse strap engaging hooks 12, 13 are positioned under the body 2.

When a purse or handbag 16 of the type having a pair of straps 17, one on each side of the purse opening, is suspended from the hooks 12, 13, the straps are held apart because the hooks are spaced apart sufficiently for this purpose. This positions the purse under the table and open sufficiently so that the user can readily access its contents 18 with one hand.

The hook members 6, 7 may be readily pivoted to a storage mode as shown in FIG. 2, in which the plane of each hook member is substantially parallel to the upper face of the body 2. The hook members are made of a springy steel. Strap hook 12 may be rotated to approximate short side 19 of body 2, and to snap onto the proximal end 9 of hook member 7. The other hook member 7 is secured in a similar fashion to thereby maintain the storage mode in fixed position so that it may be carried about in a purse in compact form without inadvertently unfolding or the hooks catching on other objects. The cushioning material, may be extended past the long sides of the body to provide a comfortable hand grip when the holder is employed for its alternate intended purpose, as a carrier for a bag having two uncomfortable carrying handles such as the conventional plastic grocery bag. Each handle is fitted on a strap hook and the hand grips the body 2.

An alternative embodiment of the invention is shown in FIG. 4. The cushioning material 10 is shown applied to only a portion of the bottom 5 of body 2. Both of the hook members 21 are provided with another type of strap hook 22 which is spring biased to close tightly on a purse strap 17 so that it can grip a purse strap at any desired point along the length of the strap. When a purse has very long straps, this enables the user to adjust the vertical position of the purse opening as desired.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A handbag holder having a broad, flat body adapted to rest upon an edge of a horizontal support surface with means extending over the edge for holding straps of a handbag, the holder comprising:

A) a body member having broad opposed upper and lower faces, two opposed narrow long sides, and two opposed narrow short sides;

B) a first hook member having a distal end and a proximal end, said distal end having a first hook extending therefrom, said first hook member being pivotally attached at its proximal end to a first of said long sides adjacent a first of said short sides, said first hook member pivotally movable between an operational mode in which said first strap hook extends substantially perpendicular below said body member and a storage mode in which said first hook member is substantially parallel to said long side and said first strap hook lies near a second of said short sides;

C) a second hook member having a distal end and a proximal end, said distal end of said second hook member having a second strap hook extending therefrom, said second hook member being pivotally attached at its proximal end to said first of said long sides adjacent said second of said short sides, said second hook member pivotally movable between an operational mode in which said second strap hook extends substantially perpendicular below said body member and a storage mode in which said second hook member is substantially parallel to said long side and said second strap hook lies near said first of said short sides;

D) said first and second strap hooks, when in said operational mode, being spaced apart sufficiently and arranged to hold separate straps of a handbag spaced apart so that said handbag will be held open for access while suspended from said strap hooks; and E) said first and second hook members overlapping each other when in said storage mode.

2. The holder according to claim 1, in which both of said hook members are provided with spring bias means for removably maintaining said storage mode.

3. The holder according to claim 2, in which said strap hooks are both provided with spring biased strap engaging means for selectively gripping a handbag strap at any position along the length of said strap.

4. The holder according to claim 1, in which said strap hooks are both provided with spring biased strap engaging means for selectively gripping a handbag strap at any position along the length of said strap.

5. The holder according to claim 1, in which said lower face is provided with a high friction resilient surface for cushioning a hand grasping said body to enable said holder to serve as a carrying handle when said strap hooks engage a bag by handles that are uncomfortable to grasp.

6. The holder according to claim 1, in which each of said hook members lies substantially in a plane, said plane being substantially orthogonal to said lower face when in said operational mode and substantially parallel to said lower face when in said storage mode.

7. The holder according to claim 2, in which each of said hook members lies substantially in a plane, said plane being substantially orthogonal to said lower face when in said operational mode and substantially parallel to said lower face when in said storage mode.

8. The holder according to claim 1, in which said upper face is arranged to display indicia.

9. The holder according to claim 2, in which said upper face is arranged to display indicia.

10. The holder according to claim 2, in which said lower face is provided with a high friction resilient surface for cushioning a hand grasping said body to enable said holder to serve as a carrying handle when said strap hooks engage a bag by handles that are uncomfortable to grasp.

* * * * *